US006338355B1

(12) United States Patent
Cheng

(10) Patent No.: US 6,338,355 B1
(45) Date of Patent: Jan. 15, 2002

(54) SAFETY BRAKE TYPE ROLLATOR

(75) Inventor: Larry M. Cheng, Taichung (TW)

(73) Assignee: Merits Health Products Co., Ltd., Taichung (TW)

( * ) Notice: Subject to any disclaimer, the term of this patent is extended or adjusted under 35 U.S.C. 154(b) by 19 days.

(21) Appl. No.: 09/599,427

(22) Filed: Jun. 22, 2000

(51) Int. Cl.[7] ..... A61H 3/04
(52) U.S. Cl. ..... 135/67; 135/85; 482/68
(58) Field of Search ..... 135/67, 85; 297/5, 297/6; 482/68; 280/87.041

(56) References Cited

U.S. PATENT DOCUMENTS 2,872,967 A * 2/1959 Kirkpatrick ..... 297/5
3,840,034 A * 10/1974 Smith ..... 135/67
4,384,713 A * 5/1983 Deutsch et al. ..... 482/68
4,706,975 A * 11/1987 Arena et al. ..... 482/68 X
4,765,355 A * 8/1988 Kent ..... 135/67
4,907,794 A * 3/1990 Rose ..... 482/68
5,409,028 A * 4/1995 Lee ..... 135/67 X

FOREIGN PATENT DOCUMENTS

GB 2319732 * 6/1998
JP 9-38162 * 2/1997

* cited by examiner

*Primary Examiner*—Laura A. Callo
(74) *Attorney, Agent, or Firm*—Rosenberg, Klein & Lee

(57) ABSTRACT

A safety brake type rollator which is normally in detained state, but it starts to advance when releasing grips installed on both handle bars are gripped, is disclosed. The elaborate utilization of lever principle associated with power transmission between two ratchet wheels realizes innovative effect of the present invention.

5 Claims, 5 Drawing Sheets

SAFETY BRAKE TYPE ROLLATOR

BACKGROUND OF THE INVENTION

1. Field of the Invention

The present invention relates to safety brake type rollator, and more particularly, to a rollator which is normally in detained state, but it starts to advance when releasing grips installed on both handle bars are gripped. The elaborate utilization of lever principle associated with power transmission between two follower blocks and ratchet wheels realizes innovative effect of the present invention.

2. Description of the Prior Art

A conventional rollator is used for helping a patient or disabled person's activity and assuring his/her security. Accordingly, braking means is indispensable especially for users who are suffering from gout or having trouble in their feet. A rollator should be constructed perfectly firm, secure, and reliable to avoid any possible accident. A braking means like that which applied for a bicycle is generally installed on a conventional rollator for the user to apply a force to braking means to both brake grips at two sides of a handle bar.

Incidentally it is hard for such a handicapped person to stop the rollator timely when an emergency arises, on the contrary. He/she might tumble down and involuntarily push forward the rollator in stead of stopping it by holding the brake grips so that causing a deplorable result. Such is the case that is often encountered by a conventionally designed rollator.

In order to overcome the shortcomings inherent to the conventional technique described above, the present inventor has delved into this matter with a long time efforts and came to realization of the present invention.

SUMMARY OF THE INVENTION

It is an object of the present invention to provide a safety brake type rollator having a stable and reliable structure which is normally in detained state unless releasing grips are gripped so as to ensure security of the rollator.

It is another object of the present invention to provide a safety brake type rollator whose braking effect can be adjusted to meet requirements of all kinds of users.

The above object can be achieved by a safety brake type rollator mainly comprising two handle bars each with a releasing grip, two foot bars, an arm rest, and a braking mechanism. The braking mechanism is constituted by two pulling wires each of them conjoined to each releasing grip with its upper end being hinged to a transmission rod at its lower end, the transmission rod is tightened to a serrated follower block below, and the follower block is further teeth combined with a ratchet wheel which is installed coaxially with a rear castor. Being exerted by the resilient force of a coil spring situated on the follower block, the follower block engages its teeth with the ratchet wheel so that the rollator can not move. As the releasing grips are gripped so as to release the downward force of the follower block, the engagement between the follower block and the ratchet wheel is loosened so that the rollator can be free to move.

BRIEF DESCRIPTION OF THE DRAWINGS

The accompanying drawings, which are included to provide a fuller understanding of the invention and incorporated in and constitute a part of this specification, illustrate an embodiment of the invention and together with the description serve to explain the principles of the invention wherein.

DETAILED DESCRIPTION OF THE PREFERRED EMBODIMENT

Figure 1:
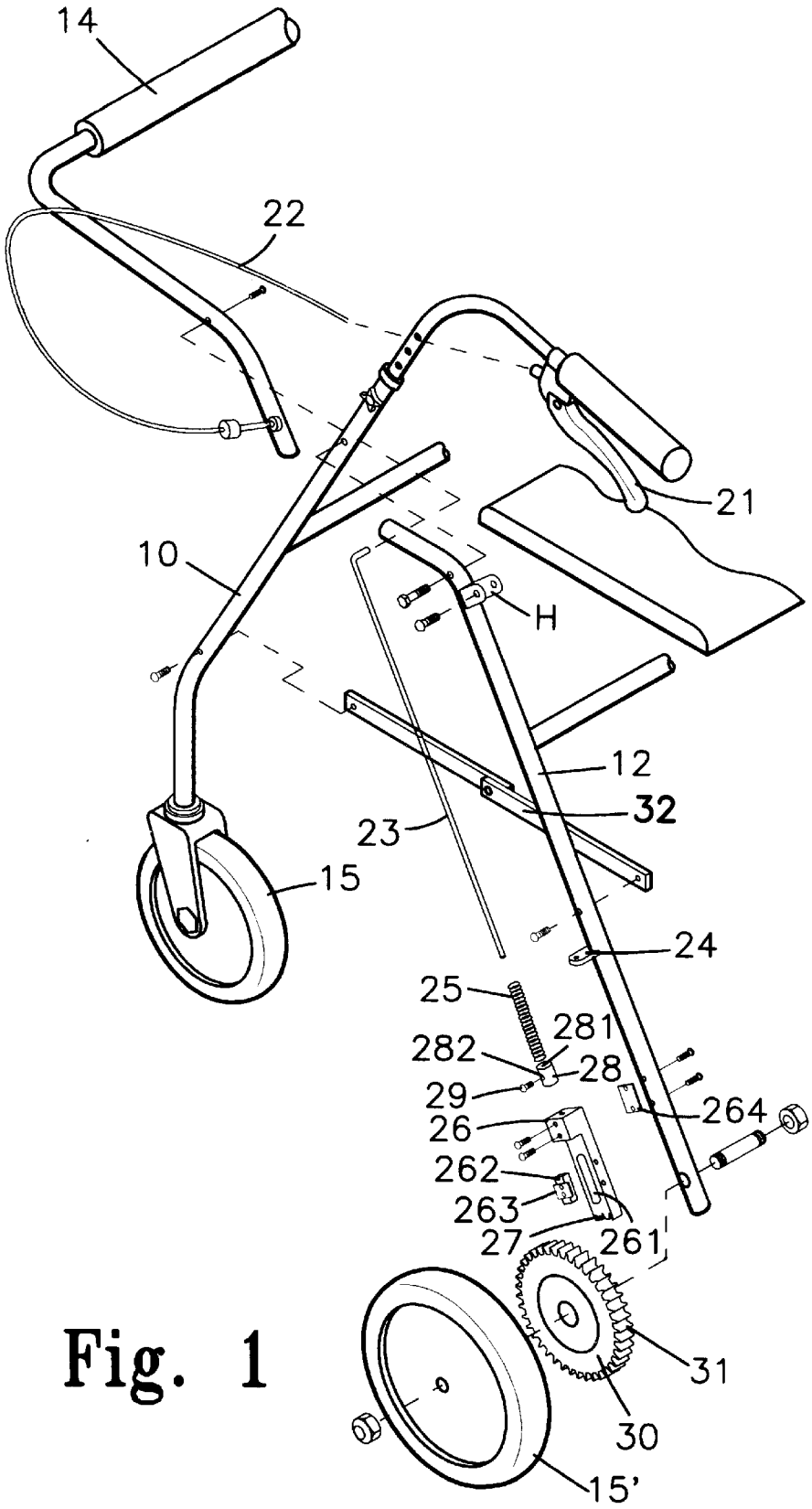
FIG. 1 is an exploded illustrative view of the present invention.
Figure 2:
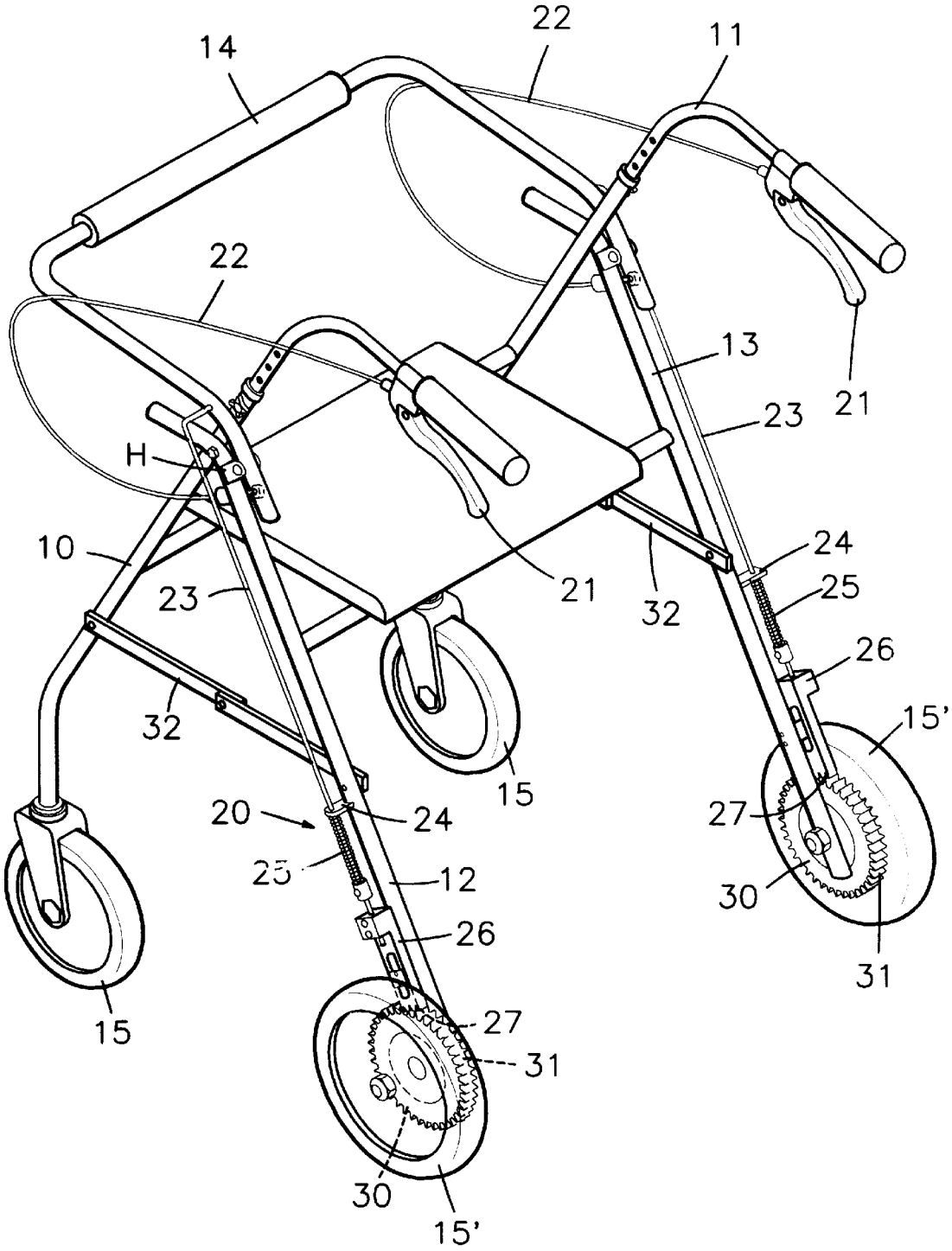
FIG. 2 is an entire contour view of the present invention.

Referring to FIGS. 1 and 2 simultaneously, a safety brake type rollator of the present invention mainly comprises two handle bars 10, 11, two foot bars 12, 13, an arm rest 14, a brake mechanism 20, two transmission rods 23, two saddles 24, two coil springs 25, two follower blocks 26, two ratchet wheels 30, two front castors 15, and two rear castors 15'. Two handle bars 10, 11 and two foot bars 12, 13 are hinged together by a hinged arm 32, and a hinged joint H is formed at the top portion of each of the foot bars 12, 13 for engaging the arm rest 14 at both sides thereof. Two front castors 15 are respectively attached to the bottom ends of the handle bars 10, 11; while two rear castors 15' are respectively attached to the bottom ends of the foot bars 12, 13.

The brake mechanism 20 includes two releasing grips 21 installed respectively at the tips of both handle bars 10, 11, each releasing grip 21 is provided with a pulling wire 22 fixed thereon which rests once on the side of the arm rest 14 before extending downward.

The transmission rod 23 is fixed at the opposite side of each hinged joint H with its one end, and tunneled through the saddle 24 and the coil spring 25 and finally engaged to the follower block 26 with its other end such that the coil spring 25 is sandwiched between the saddle 24 and the follower block 26 having a serrated bottom edge 27.

Below the follower block 26, there is a ratchet wheel 30 coaxially hinged together with the rear castor 15', a plurality of teeth 31 are formed around the edge of the ratchet wheel 30.

Figure 4:
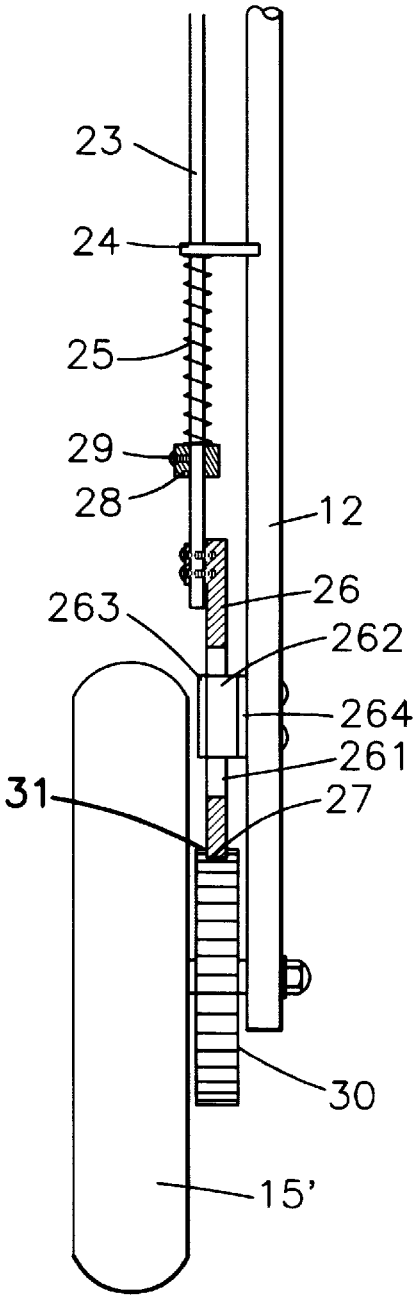
FIG. 4 is an enlarged view of a part of the brake mechanism of the present invention at braked state.

As shown in FIG. 4, a long guide slot 261 is formed longitudinally along the follower block 26, and a slider 262 shorter than the guide slot 261 in length is fitted in the guide slot 261 such that it is slidable along longitudinal direction thereby enabling the follower block 26 to linearly reciprocate in the longitudinally direction. In addition, at both sides of the slider 262, there are respectively provided guard plates 263, 264 fixed with fixing element such as set screws on the foot bars 11, 12 so as to prevent possible radial excursion of the follower block 26.

Figure 5:
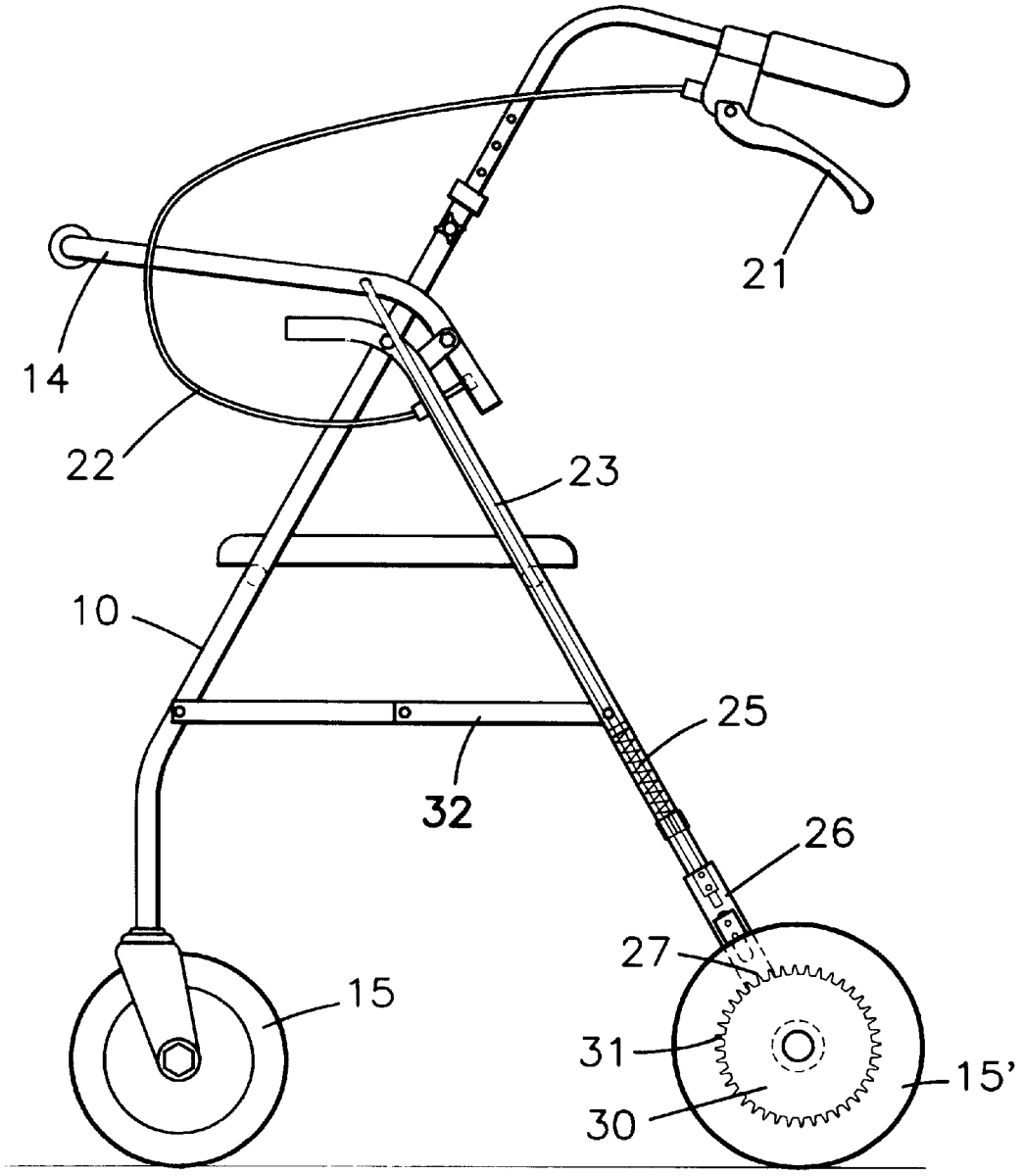
FIG. 5 is a view showing that the rollator of the present invention is at the detained state.

FIGS. 4 and 5 are the drawings which illustrate the brake mechanism of the present invention is at the braked state. As shown in FIG. 4, the follower block 26 is pressed down by the coil spring 25 so as to engage its serrated edge 27 with the teeth 31 of the ratchet wheel 30 thereby detaining the rear castor 15' not to move, at this time, the releasing grip 21 remains in undisturbed state without being gripped.

Figure 3:
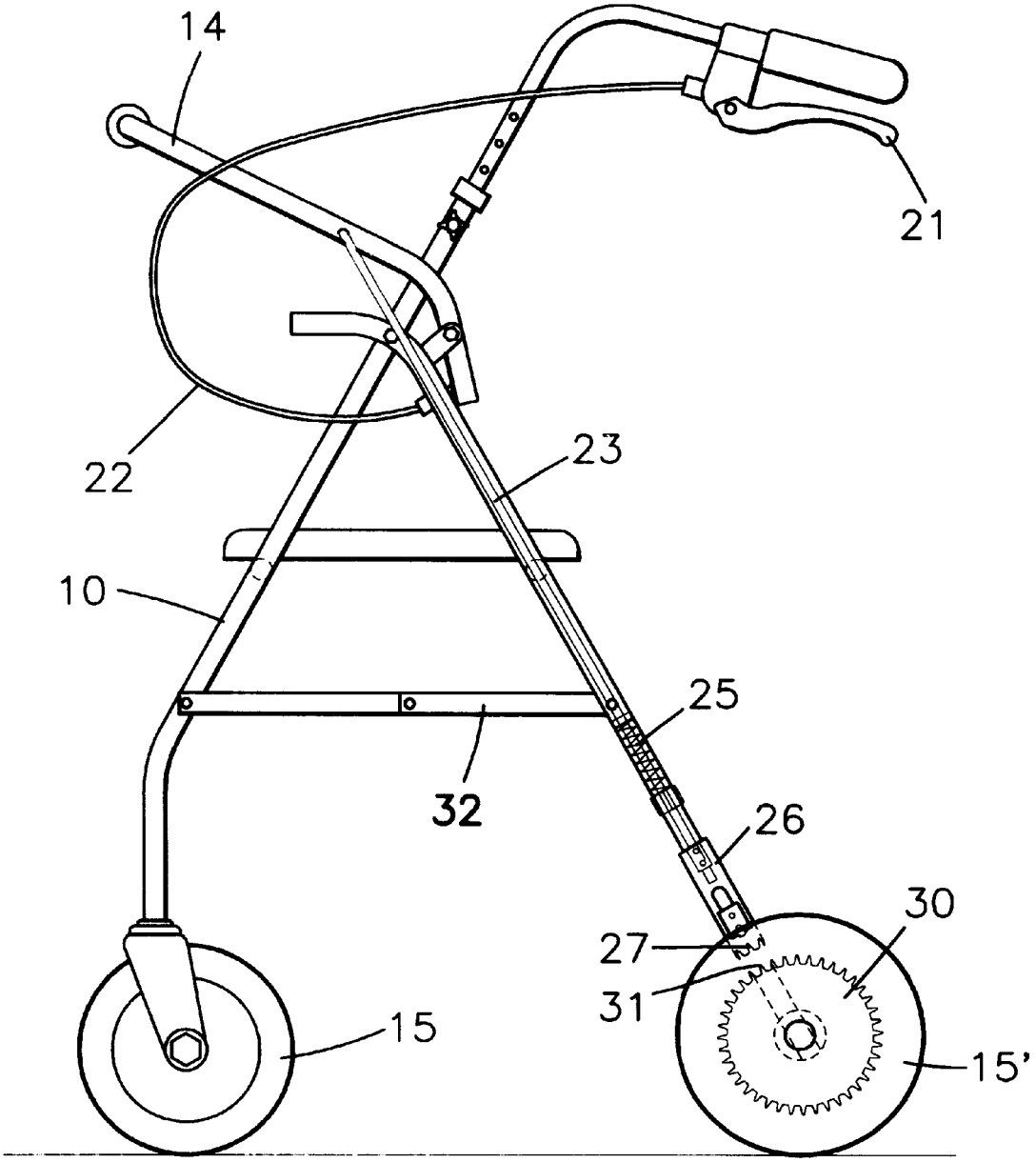
FIG. 3 is a view showing that the brake mechanism of the present invention is at the released state by gripping the releasing grip.
Figure 6:
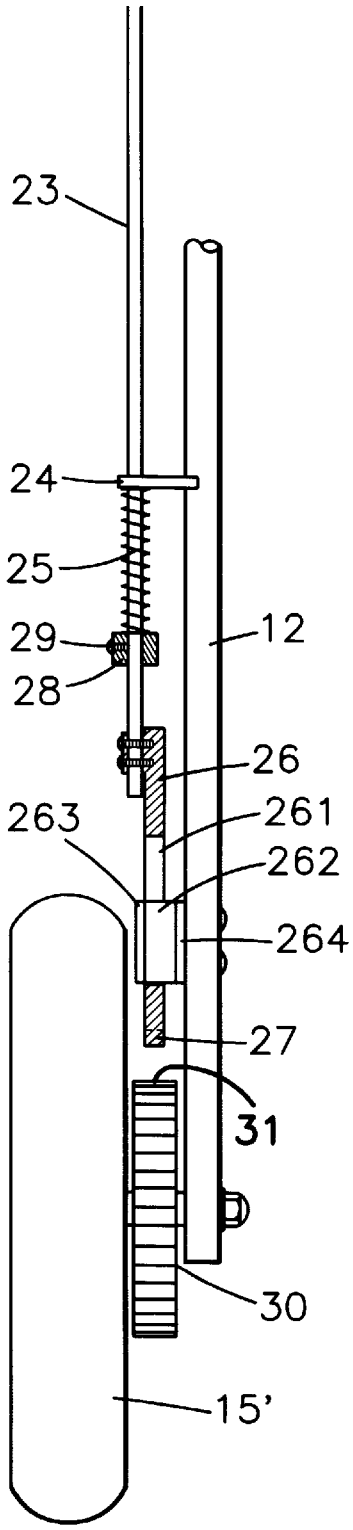
FIG. 6 is an enlarged view of a part of the braking mechanism of the present invention at released state.

On the contrary, as shown in FIGS. 3 and 6, when the releasing grips 21 are gripped, the releasing wires 22 transmit a downward force to both sides of the arm rest 14 such that it is raised up according to lever principle with respect to the hinged joint H as a fulcrum. At this time each transmission rod 23 is also displaced upward with the result that the serrated edge 27 of the follower block 26 is separated from the teeth 31 of the ratchet wheel 30 thus releasing detention of the rear castor 15'.

Moreover, in order to appropriately adjust resiliency of each coil spring 25 as shown in FIGS. 4 and 6, the present invention further provides an adjustor block 28 for each transmission rod 23 with a through hole 281 for the rod 23 to pass through after the rod 23 tunnels through the coil spring 25 and then is fixed to the follower block 26. A threaded hole 282 is provided in each adjustor block 28 for tightening it to the transmission rod 23 with a set screw 29. With this construction, the position of the adjustor block 28 between the saddle 24 and the follower block 26 can be properly set hence in turn determines the position of the coil spring 25 and offer it different resilient force for various users to control the tension of the releasing wire 22 and the force to grip the releasing grip.

Besides, the foot bars 12, 13 are extendable and can be inclined so as to align the rear castor 15' and the releasing grip 21 in the same vertical line to the ground as shown in FIGS. 3 and 5. By so the gravity center of the entire rollator can be kept stably in a lower position.

The safety brake type rollator of the present invention is much more advantageous in comparison with any conventional one in many respects, for example, the rollator of the present invention will never accidentally run uncontrolled even situated on a sloped surface unless the releasing grips 21 are gripped. Especially, when the arm rest 14 is accidentally pressed down, each transmission rod 23 will also displace downward so that it engages with the ratchet wheel 30 thereby detaining the rear castor 15', that means achieving the braking effect. Besides, an adjustor block is provided for controlling the tension of each releasing wire 22 and gripping force of each releasing grip 21 for all kinds of users. In addition, the rear castor 15' and the releasing grip 21 can be aligned in the same vertical line to the ground so that the gravity center of the rollator can be kept stably in a lower position.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A safety brake type rollator comprising two handle bars, two foot bars, an arm rest, a brake mechanism, two transmission rods, two saddles, two coil springs, two follower blocks, two ratchet wheels, two front castors, and two rear castors, said two handle bars and said two foot bars are hinged together by a hinged arm, and a hinged joint is formed at top portion of each of said foot bars for engaging said arm rest at both sides thereof, said two front castors are respectively attached to the bottom ends of said handle bars, while said two rear castors are respectively attached to the bottom ends of said foot bars;

said brake mechanism including two releasing grips installed respectively at the tips of said both handle bars, each releasing grip is provided with a pulling wire fixed thereon which rests once on the side of said arm rest before extending downward;

said transmission rod is fixed at the opposite side of each said hinged joint with its one end, and tunneled through said saddle and said coil spring and finally engaged to said follower block with its other end such that said coil spring is sandwiched between said saddle and said follower block having a serrated bottom edge;

said two ratchet wheels are coaxially hinged together respectively with said two rear castors below said two follower blocks, a plurality of teeth are formed around the edge of each said ratchet wheel;

with such a structure, said rollator is at detained state in case said releasing grips are not gripped, while said rollator is free to move in case said releasing grips are gripped.

2. The rollator as claimed in claim 1, resiliency of said coil spring can be adjusted by providing an adjustor block for each transmission rod with a through hole for said rod to pass through after tunneling through said coil spring and then fixed to said follower block, a threaded hole is provided in said adjustor block for tightening it to said transmission rod with a set screw, with this construction, offering said coil spring different resiliency for controlling tension of said releasing wire and the force to grip said releasing grip.

3. The rollator as claimed in claim 1, wherein said foot bars are extendable and can be inclined so as to align said rear castor and said releasing grip in the same vertical line to the ground so that the gravity center of said entire rollator can be kept stably in a lower position.

4. The rollator as claimed in claim 1, wherein a long guide slot is formed longitudinally along said follower block, and a slider is fitted in said guide slot such that it is slidable along longitudinal direction thereby enabling said follower block to linearly reciprocate in the longitudinal direction.

5. The rollator a s claimed in claim 4, wherein a guard plate whose width is larger than that of said long guide slot is provided at each side of said slot thereof so as to prevent possible radial excursion of said follower block.

* * * * *

UNITED STATES PATENT AND TRADEMARK OFFICE

CERTIFICATE OF CORRECTION

PATENT NO. : 6,338,355 B1
DATED : June 22, 2002
INVENTOR(S) : Cheng

It is certified that error appears in the above-identified patent and that said Letters Patent is hereby corrected as shown below:

Title page,
Item [*] Notice, delete the phrase "by 19 days" and insert -- by 20 days --

Signed and Sealed this

Twelfth Day of October, 2004

JON W. DUDAS
*Director of the United States Patent and Trademark Office*